US005551223A

United States Patent [19]

Nickolay

[11] Patent Number: 5,551,223

[45] Date of Patent: Sep. 3, 1996

[54] PROCESS AND APPARATUS FOR OPTIMIZING SPIN GEOMETRY OF A RING SPINNING MACHINE

[75] Inventor: Helmut Nickolay, Uhingen, Germany

[73] Assignee: Zinser Textilmaschinen GmbH, Ebersbach/Fils, Germany

[21] Appl. No.: 380,843

[22] Filed: Jan. 30, 1995

[30] Foreign Application Priority Data

Jan. 28, 1994 [DE] Germany ..... 44 02 582.3

[51] Int. Cl.[6] ..... D01H 7/46; B65H 57/00

[52] U.S. Cl. ..... 57/264; 57/1 R; 57/119; 57/352; 57/354; 57/356

[58] Field of Search ..... 57/264, 1 R, 352, 57/354, 356, 119, 122, 136, 93, 99, 95, 137

[56] References Cited

U.S. PATENT DOCUMENTS

| | | | |
|---|---|---|---|
| 2,690,643 | 10/1954 | Vella | 57/356 |
| 2,747,360 | 5/1956 | Vella | 57/356 |
| 2,770,093 | 11/1956 | Gwaltney | 57/99 |
| 2,949,726 | 8/1960 | Latus | 57/356 |
| 3,256,683 | 7/1966 | Andersen et al. | 57/99 |
| 3,521,441 | 7/1970 | Lamparter | 57/93 |
| 4,336,684 | 6/1982 | Hartmannsgruber et al. | 57/95 |
| 4,531,353 | 7/1985 | Majette | 57/264 |
| 4,677,819 | 7/1987 | Stahlecker | 57/264 |
| 4,685,285 | 8/1987 | Leonard | 57/354 |
| 4,947,634 | 8/1990 | Sturwald | 57/93 |
| 5,099,640 | 3/1992 | Kobayashi et al. | 57/264 |
| 5,341,633 | 8/1994 | Nishikawa et al. | 57/264 |
| 5,343,685 | 9/1994 | Burgermeister | 57/1 R |
| 5,375,406 | 12/1994 | Gorlich et al. | 57/308 |

FOREIGN PATENT DOCUMENTS

| | | |
|---|---|---|
| 0282713 | 9/1988 | European Pat. Off. . |
| 0289009 | 11/1988 | European Pat. Off. . |
| 2140067 | 2/1972 | Germany . |
| 3624212 | 1/1988 | Germany . |
| 3636288 | 4/1988 | Germany . |
| 3732052 | 4/1989 | Germany . |
| 3928755 | 3/1991 | Germany . |
| 4211684 | 10/1993 | Germany . |

OTHER PUBLICATIONS

J. Zakrzewski et al; "Die Fadenspannung Verandernde Einfluse Beim Spinnen"; Textilbetrieb–Feb. 1980; 5 pages.

*Primary Examiner*—William Stryjewski
*Attorney, Agent, or Firm*—Herbert Dubno

[57] ABSTRACT

A method for optimizing the spinning geometry of a spinning machine in which the lengths of the path segments between the drafting output and rolls and the yarn guide, between the yarn guide and the balloon constricting ring, between the balloon constricting ring and the traveller, or other angles are controlled in response to the yarn break frequency and/or spinning force and, when necessary, the spindle speed is also controlled to minimize the spinning force. The system can use a fuzzy logic.

20 Claims, 4 Drawing Sheets

PROCESS AND APPARATUS FOR OPTIMIZING SPIN GEOMETRY OF A RING SPINNING MACHINE

FIELD OF THE INVENTION

The invention relates to a process for optimizing the spin geometry of a ring spinning machine as well as to a ring spinning machine in which this process is realized.

BACKGROUND OF THE INVENTION

The thread quality obtainable with a ring spinning machine as well as its productivity are determined largely by the spin geometry, i.e. the configuration of the yarn path from the discharge roller pair of the drafting frame, through the yarn-guide eye and the balloon constriction ring, to the traveler ring and onto the sleeve, tube or core upon which the bobbin is wound, and especially by the lengths of the individual yarn segments and their angles to one another. The spin geometry is usually matched to the length of the bobbin tube used, the ring diameter which has been selected, the fineness of the spun yarn, the spun yarn type and other parameters.

In conventional ring spinning machines the ring rail and the rail for the balloon-constrictor ring and the yarn-guide eyes are vertically moved and adjustably positioned relative to or counter one another by means of mechanical drives.

For this purpose it is known from DE 37 32 052 A1 to wind the tractive elements from which the ring rail or the rail for the balloon constrictor rings and yarn guides are suspended on respective windlass drums and to drive each windlass drum by a respective drive motor.

In this way the different types of rails can be moved independently from one another, whereby these different movements can be easily adjustable and variable.

The control of the movements of these spin-geometry-influencing elements of the ring spinning machine was effected in the known machines in accordance with a predetermined program that either was a compromise for the various yarns to be spun or which had to be determined anew for each yarn to be spun and/or optimized. In other words: If for a type of yarn to be spun there is no optimal program in the machine controller, either the spinning process must be carried out with non-optimized spinning geometry, i.e. with reduced spinning quality or quantitative results, or a costly manual optimization of the spin geometry must be carried out.

A further drawback of the conventional machines is that the parameters influencing spinning quality, like for example temperature or humidity of the spinning chamber, and especially fluctuations thereof, cannot be readily compensated during a spinning process.

OBJECTS OF THE INVENTION

It is the principal object of the present invention, therefore, to provide an improved process for optimizing the spin geometry of a ring spinning machine which ensures that the spin geometry will automatically be optimized even during a spinning process and thus ensures high spinning quality at predetermined or maximum productivity.

Another object of the invention is to provide a method of controlling the spin geometry of a ring spinning machine whereby drawbacks of earlier systems are obviated.

Still another object of the invention is to provide an improved ring spinning machine which enables optimization of the spin geometry by the improved process of this invention.

SUMMARY OF THE INVENTION

These objects and others which will become apparent hereinafter are attained, in accordance with the invention, in a process for optimizing the spin geometry of a ring spinning machine in which the spin geometry is defined as a configuration of a path of yarn to be spun from a pair of discharge rollers of a drafting frame, past a yarn-guide eye, past a balloon constricting ring, through a traveler orbiting a bobbin tube on a traveler ring and then to the bobbin tube for winding in a bobbin thereon, and wherein the ring spinning machine has spin-geometry influencing elements including a movable ring rail for the traveler ring, a movable rail for the balloon constricting ring and means for moving said yarn-guide eye. According to the invention:

(a) at least one measured value is obtained and is selected from the spinning force, a parameter correlated with the spinning force, and yarn-breakage frequency;

(b) this measured value is fed as an input value to a controller; and (c) the controller generates a control value for at least one positioning drive for at least one of the spin-geometry-influencing elements and controls the position thereof within a predetermined adjustment range so that (c1) the yarn-breakage frequency does not exceed a predetermined value or is a minimum, and/or (c2) the spinning force or the yarn tension does not exceed a predetermined value or is a minimum.

The invention is based upon the recognition that the spinning force or the yarn tension and/or the yarn-break frequency can serve as parameters for optimizing the spinning process. The yarn tension, i.e. the tension in the thread between the supply roller pair and the bobbin, especially in the case of combed yarn spinning, is of the greater significance. In the spinning process itself there is dependency on this tension above all of the yarn-break frequency, the yarn tension determining the extensibility of the yarn largely, the elongation to break of the yarn increasing with decreasing spinning tension. In a lay of yarns and above all in a warp for weaving, the elongation to break is determinative of the breaking of the yarns so that during the spinning process the yarn tension should be minimal or at least should not exceed a predetermined value.

Since the yarn break frequency is determined substantially by the yarn tension, the latter alone or in combination with other parameters can be used to optimize the spinning geometry.

The goal of a minimum yarn break frequency or spinning force or yarn tension can be achieved according to the invention in that at least measured values for the spinning force and/or the yarn break frequency are fed as input values to at least one controller with the controller regulating at least one positioning drive or servodrive (effector) of at least one of the elements of the ring spinning machine influencing the spinning geometry in the controlled manner. Thus, without any manual alteration of the spinning geometry and even during a spinning process, the latter can be optimized.

In a preferred embodiment of the invention the controller can additionally regulate the spindle speed within a predetermined speed range so that the yarn break frequency and/or the spinning force or the yarn tension does not exceed a predetermined value or is minimal.

If the aforementioned target cannot be achieved within the predetermined range of settings, the controller can include means for generating a defect signal which can trigger a service call and/or an alarm.

The spinning geometry influencing and controller-regulating position can be, for example, one or more of the following:

the vertical position of the yarn guide eye, the vertical position of the balloon-confining ring, the vertical position of the traveller and spindle, or the horizontal distance between the drafting frame and the spindle.

In one advantageous configuration of the invention, the controller can receive additional input values respectively corresponding to measurements of the temperature and/or the air humidity in the region of the ring spinning machine.

According to the invention, the control process can be carried out at predetermined time-spaced intervals. The controller can respond to the entire range of settings or only a portion of the range to generate a setting for the controlled element in predetermined steps so that the resulting measured values for the input parameter can provide optimum values of at least one positioning element.

Where a plurality of parameters are to be obtained, the control can be carried out so that for each setting of an element, a corresponding adjustment is generated by the controller and the positions of all of the elements in the path of the yarn which are adjusted to control the spinning geometry, can be set in a predetermined sequence, each via a sensing and optimization operation.

In a preferred embodiment of the invention, the controller operates as a fuzzy system in which the measurement signals fed to the controller are fuzzified in accordance with the conventional approach of fuzzy logic based upon the knowledge of the response of the system and weighted accordingly. The setting values are obtained by defuzzifying the results of the logic and weighting.

Since in a ring spinning machine the most important input values to the controller can readily vary from spinning station to spinning station, in a preferred embodiment of the invention these values are measured at a plurality of spinning stations or at all spinning stations and a measured valued from the corresponding spinning stations is fed to the controller. The averaging can be carried out by excluding those spinning stations at which at the time of the measurement, no spinning is being carried out or at which a yarn break has occurred. This can ensure that measured values which are smaller than a predetermined threshold are not averaged into the input to the controller.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
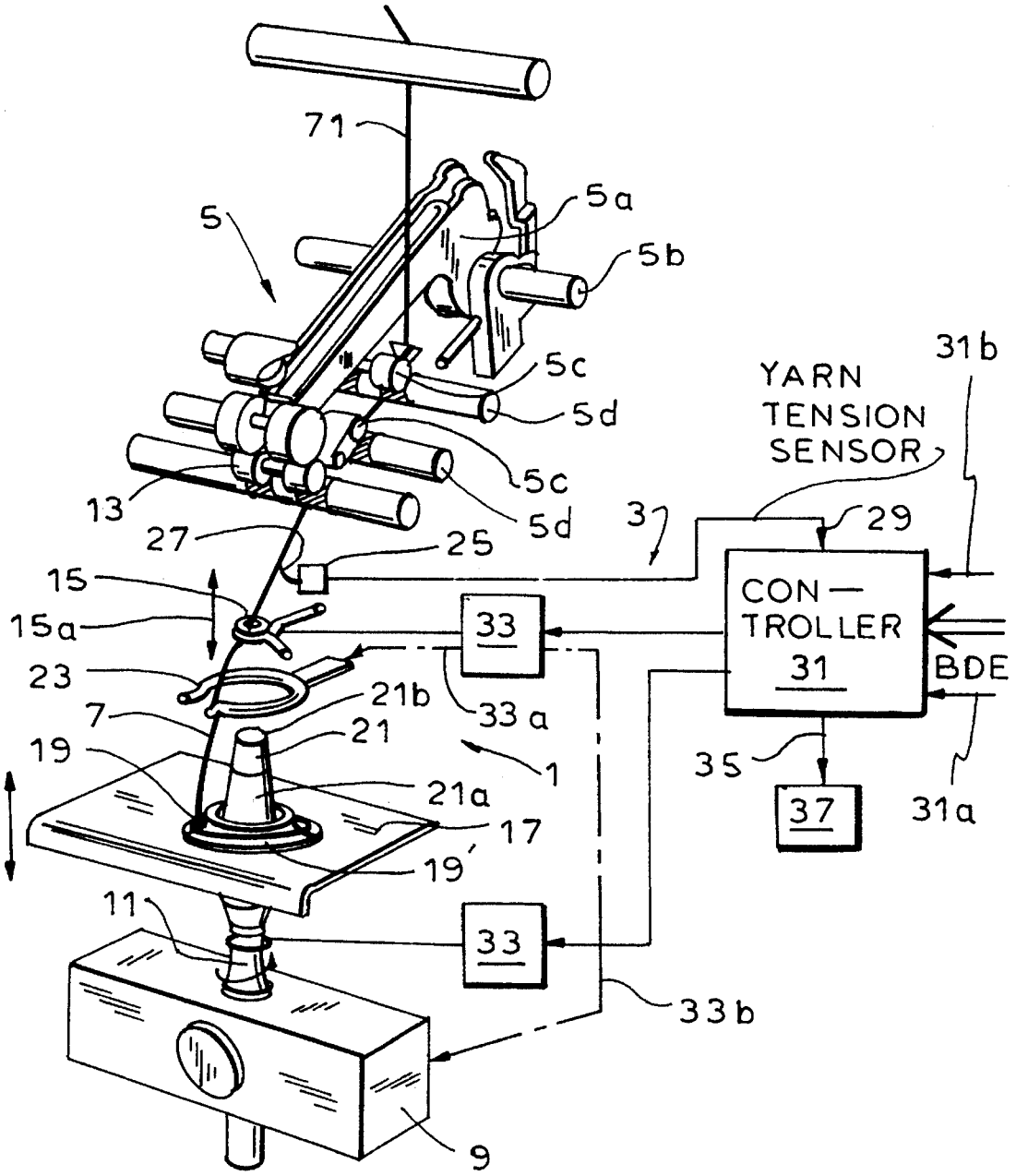
FIG. 1 is a perspective view of the components of a ring spinning machine defining the spinning geometry in accordance with the present invention.

FIG. 1 schematically shows the construction of one station of a ring spinning machine not further shown in detail, but illustrating all of the parts important for an understanding of the invention. The machine control system is represented in the form of a block diagram.

The station 1 is comprised of a drafting frame 5 for stretching and supplying a roving 7' to a spindle 11 rotatable about a vertical axis on the spindle rail 9.

The drafting frame 5 comprises, as is usually the case, a loading arm 5*a* swingable about a shaft 5*b* and pressing a number of rollers 5*c* against the roving 7' as it passes over driven rollers 5*d* of the drafting frame. At the output side of the drafting frame, the yarn 7 passes between the supply rollers of a supply roller pair 13 and then through an eye of a yarn guide 15 to a traveller ring 19 which runs around the rail ring 19' on the rail 17 which is vertically shiftable as represented at 17*a* to deposit the yarn cap 21*a* on the bobbin 21 which has a bobbin core tube 21*b* mounted on the spindle 11.

Thus, upon rotation of the spindle 11 or the bobbin 21, the traveller 19 is entrained in a circular path around the bobbin so that the yarn is wound on the bobbin at a rate determined by the difference between the spindle rotational speed and the orbiting speed of the traveller 19, the yarn 7 being simultaneously twisted or spun.

The vertical movement 17*a* of the ring rail 17 provides the predetermined pattern of deposit of the yarn in the bobbin and hence the shape of the latter. The arrow 17*a*, of course, is not only vertical but is parallel to the spindle and bobbin axis.

Because of the relatively high spindle or bobbin rotary speed and the correspondingly high orbiting speed of the traveller 19, the yarn segment between the yarn guide eye 15 and the traveller 19 is subjected to relatively high centrifugal force. This centrifugal force gives rise to a radial ballooning of the yarn segment so that with rotation of the yarn segment about the vertical axis of the bobbin 21, a yarn balloon is generated.

To reduce the spindle force, i.e. the tensile force which is effective between the supply roll pair 13 and the yarn winding on the bobbin 21, in the region of the balloon, a balloon constricting ring 23 is provided to limit the spread of the balloon. The balloon constricting ring 23 has a predetermined vertical position between the yarn guide 15 and the traveller 19 and limits the diameter of the yarn ballooning to a predetermined value. The balloon-constricting ring has its optimum position in the horizontal plane or the center of gravity of the balloon. The balloon-constricting rings 23 and the thread guides 15 may be provided in spaced relationship along each working side of the machine on respective rails which have not been shown.

The spinning geometry of the ring spinning machine, i.e. the path of the yarn from the supply roller pair 13 through the eye of the yarn guide 15 and through the balloon constricting ring 23 to the traveller 19 and with respect to the individual yarn segments and their angles with one another can be varied with respect to the ring diameter, the fineness of the yarn and the spun-fiber type and other parameters.

For example, for coarse yarns relatively small run-off angles are advantageous while for relatively fine yarns large run-off angles have proved to be advantageous. The run-off angle is the angle included with the vertical by the yarn segment between the supply rail pair 13 and the yarn guide 15.

To set the spin geometry in a conventional ring spinning machine, the balloon-constricting ring 23 or the yarn guide 15 (or both) are mounted on respective rails, for example with individual adjustments in vertical positions. Thus German Patent Document DE 37 32 052 teaches the adjustment of the rails for the yarn guide 15 and the balloon confining ring 23 during a yarn-travel process in accordance with a predetermined function, this function being correlated with the average value of the vertically oscillatory movement of the ring rail with time.

The determination of these functions must be obtained separately for each spinning operation, whereby specific parameters, especially the spindle speed, the yarn fineness and the fiber type, must be taken into consideration.

The present invention is based upon the recognition that especially the spinning force and yarn-break frequency parameters can serve as measures for an automatic optimization of the spinning geometry and therewith the spinning quality.

The embodiment of the apparatus illustrated in FIG. 1 thus can comprise a sensor 25 for the yarn tension and which measures that tension between the supply roller pair 13 and the yarn-guide eye 15. The sensor 25 can have a finger 27 which rests against the yarn 7 and thus is responsive to any change in position thereof representing a measure of a change in tension. Instead of this sensor, some other sensor can be used which responds to the spinning force or a parameter correlated therewith.

The sensor 25 shown in FIG. 1 has, however, the advantage that it can serve simultaneously as a yarn break detector. A yarn break is detected by the sensor 25 when no force is applied any longer to the finger 27 so that the deflection of the finger by the yarn returns to zero.

The output signal 29 from the sensor 25 is applied to a control unit or controller 31 which can be a separate unit or part of the central machine control system.

The control unit 31 evaluates the output signal 29 of the sensor 25 and outputs a signal for repositioning one or more of the elements of the spinning machine controlling the path geometry, e.g. a positioner or effector 33. The latter can be connected to the rail carrying the yarn guides 15 on each side of the ring spinning machine so that it can control the vertical position 15*a* thereof. The effector or another effector can be connected to the rail carrying the yarn balloon restricter rings 23 as represented at 33*a*, or to the rail or base 9 carrying the spindles as represented by the dot-dash line 33*b* to a positioner for the output rolls 13 so that the lengths of the yarn segments in the path between the drafting frame and the ring 19 or the angles between these segments can be controlled in the manner which has already been described.

When the position of the yarn guide 15 is adjusted by the servomotor 33, there is a variation in the average height of the yarn balloon formed between the yarn guide 15 and the ring 19.

The purpose of positioning the yarn guide 15 in response to the controller 31 is to minimize the spinning force or to ensure that the latter will not exceed a predetermined threshold value. The spinning force is, of course, dependent upon a number of parameters and hence the control unit 31 can be responsive either to the spinning force directly or to one of the parameters which depends therefrom and can be supplied with a dependent parameter, for example from a central operation data bank or memory unit represented at BDE.

When the control unit 31 determines that the predetermined spinning force cannot be achieved by an adjustment in the vertical direction of the yarn guide position, i.e. The full adjustment range of the yarn guide has been utilized without achieving the desired spinning force, the control unit 31 can generate a failure or warning signal 35 which can be applied to an operator call unit 37 requesting operator intervention or maintenance.

The control unit can also, in this case, operate the regulator 39 of the spindle drive to reduce the spindle speed and thereby achieve a reduction of the spinning force in this manner.

The control unit 31 may also respond to the yarn-break frequency as an input parameter from the sensor 25 for regulating the vertical position of the yarn guide 15. The yarn break frequency can be obtained from a single working station, or from selected working stations or from all of the working stations of the ring spinning machine, but preferably is derived from a representative cross section of yarn break detectors whose signals are supplied to the control unit 31 and can then respond to the yarn break frequency.

It will be selfunderstood that the signals of the yarn break detectors can be evaluated separately to determine respective yarn break frequencies which can be averaged at the control unit 31.

In a preferred embodiment of the invention, not only the spinning force at a single working station 1 of the ring spinning machine is detected but rather the spinning force is determined at a multiplicity of working stations and the output signals 29 of the plurality of sensors 25 are supplied to the controlled unit 31. The voltage levels of these signals can be averaged to form an average value with the signals from spinning stations at which a yarn break is in existence at the measuring time are excluded, or where the spinning process is interrupted or the spinning position is out of operation. This can be achieved by providing the control unit 31 with circuitry which ignores those sensor signals 39 whose value can lie below a predetermined threshold or is equal thereto.

If the yarn break detectors and the sensors for determining the spinning force are formed as separate sensors, the control unit can ignore signals from the spinning force sensors which have been indicated by the corresponding yarn break detectors to be characterized by a thread break or the absence of a yarn.

Where the control process is provided with closed-loop regulation for a feedback system, the regulator or controller may be operated in a variety of ways.

Since the optimum spinning geometry can only be achieved during operation of the ring spinning machine with the aforedescribed control system, initially it is necessary to select reasonable starting values for the variable parameters: vertical yarn guide position and spindle rotary speed. Preferably the starting values for the initial position of the yarn guide and spindle speed are so selected that a satisfactory productivity is achieved, these values usually being close to those which will be set automatically in practice.

One possibility, in accordance with the invention is that the controller 31 is started with values from the permissible setting range by stepping the position of the yarn guide 15 through this range, detecting the spinning force associated with each position and storing the value of that spinning force at an address corresponding to the position of the yarn guide in the range of variability thereof. From these measured values the controller can then be set for the height of the yarn guide which gives the minimum spinning force as calculated automatically, for example, by nonlinear regression, the effector 33 being then controlled so that the starting position of the yarn guide 15 is this optimally determined vertical position.

Should the control unit 31, after comparing the spinning force in a position of the yarn guide with stored value for the maximum allowable spinning force, determine that the latter has been exceeded, the controller 31 can thus regulate the speed control 39 of the spindle drive to reduce the spindle speed by a predetermined increment. If, after this reduction in spindle speed, the spinning force is less than or equal to the maximum value, this part of the control process terminates and the regulation of the yarn guide height resumes without variation in the spindle speed to minimize the spinning force. If, however, the incremental reduction in the spindle speed does not reduce the spinning force to a level below or equal to the maximum permissible value, the control of the spindle speed continues until the spinning force falls below or equal to the maximum permissible value. In other words the control of the spindle speed continues until this condition is fulfilled.

The control processes can be continuous or can be carried out at time-spaced predetermined intervals so that practically during the entire operation of the ring spinning machine, at least during a cycle of winding of the bobbins thereof, the vertical position of the yarn guide 15 and the spindle speed always remain in optimum ranges. In this manner, a ring spinning machine according to the invention is continuously operated with maximum productivity with a predetermined and satisfactory spin quality.

Of course, the invention is not limited to control only of the vertical position of the yarn guide 15 and the spindle speed by the control system. Indeed, optional other parameters influencing the spinning geometry can be controlled, include, as already noted, the vertical position of the balloon constricting ring 23 or the horizontal spacing of the feed roller pair 13 from the vertical axis of the spindle 11.

The latter, however, requires considerable cost since that necessitates a horizontal shift of the entire drafting apparatus.

Furthermore, additional input values can be supplied to the controller 31. These can include at 31*a*, for example, the ambient temperature and at 31*b* the ambient relative humidity or moisture content of the air in the region of the ring spinning machine, as determined by suitable sensors.

Alternatively, additional controllers can receive such inputs and the outputs of these controllers in controller 31 can be combined by appropriate logic circuits.

The more inputs which are provided for the controller 31 and the greater the number of outputs and effectors for the spinning geometry which are controlled thereby, the more complicated the system becomes and the more complex is the controller which is necessary. In fact, in some cases, conventional control techniques can become impossible when the complexity is raised to an extreme level. As a consequence, I have found that it may be advantageous, instead of providing a plurality of controllers operating by more conventional or analog control techniques, to utilize a fuzzy control system for complete control of the spinning machine operation.

The earlier control systems differ from fuzzy control in that they provide function generators between an input and an output which performs a well defined mathematical operation so that for a certain input value there will always be a certain output value or response defined by the rule of the function generator. The rules of the function generator in the control system are, of course, formulated by experts knowledgeable in the spinning field.

By contrast, in the fuzzy control system, equivalent function generators are eliminated and, instead of having a fixed mathematically determined response by a function generator to an input value, yielding fixed output value, the physical input and output values of the controller are described by so-called linguistic variables whose possible values are not represented by numbers but are "words" which represent quantities which are not sharply defined. These terms of the linguistic variables are described by association or characterizing functions relate a predetermined physical value range of the corresponding physical variables to an association which represents a value between 0 and 1 and can be characterized by a word showing relative location along the latter scale. This process is referred to as "fuzzy".

After fuzzifying of all input values of the fuzzy system or controller, the convention of the numerical inputs to linguistic variables must then be subjected to so-called fuzzy inference in the next step.

The fuzzy inference step relates the situation represented by the linguistic variable to a reaction and this fuzzy inference is carried out in response to "if-then" rules in a tables of such rules which are formulated. When the "if" part describes the situation, the corresponding "then" part describes the reaction. The fuzzy inference consists of two components, namely, an aggregation or calculation of the "if" parts of the rules and the calculation of the "then" parts of the rules, referred to as composition. After carrying out the fuzzy inference, from the "then" rules which apply, the linguistic variables must be converted into responses of the effectors, i.e. by a defuzzification.

Figure 2:
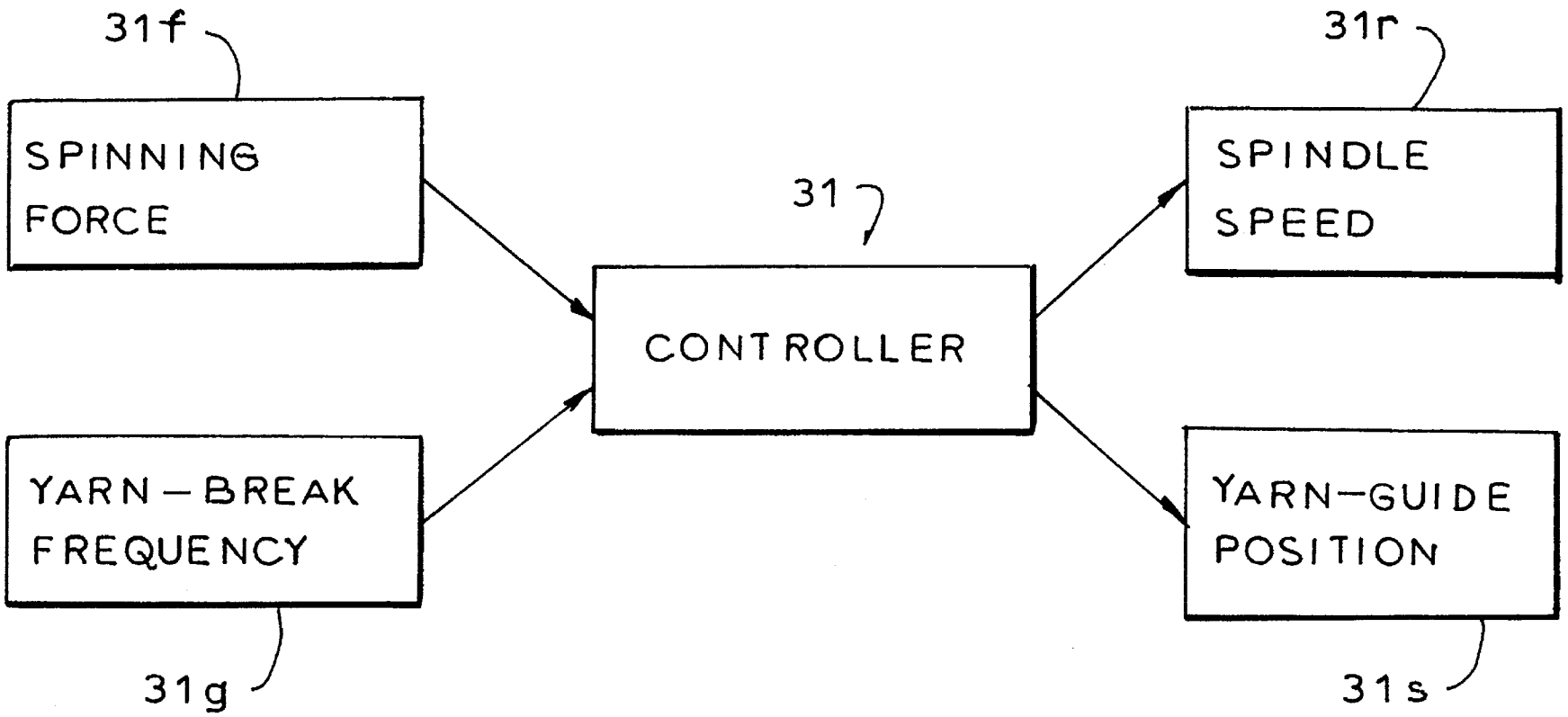
FIG. 2 is a schematic block diagram for the spinning machine shown for one spinning station.

FIG. 2 shows schematically a block diagram of the controller 31 with inputs 31*f* representing the spinning force and 31*g* representing the yarn break frequency. The outputs 31 *r* represent the spindle speed and 31*t* the yarn guide position.

Figure 3A:
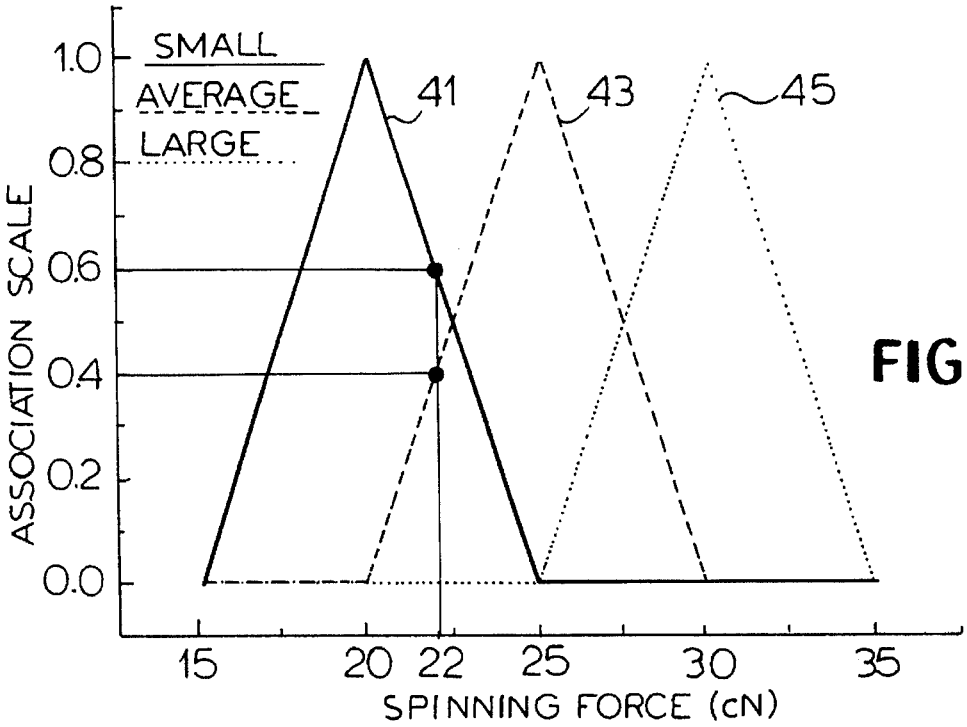
FIG. 3*a* is a graph of the variation of the linguistic variable spinning force utilizing a controller operating with fuzzy logic in the system of FIGS. 1 and 2.
Figure 3B:
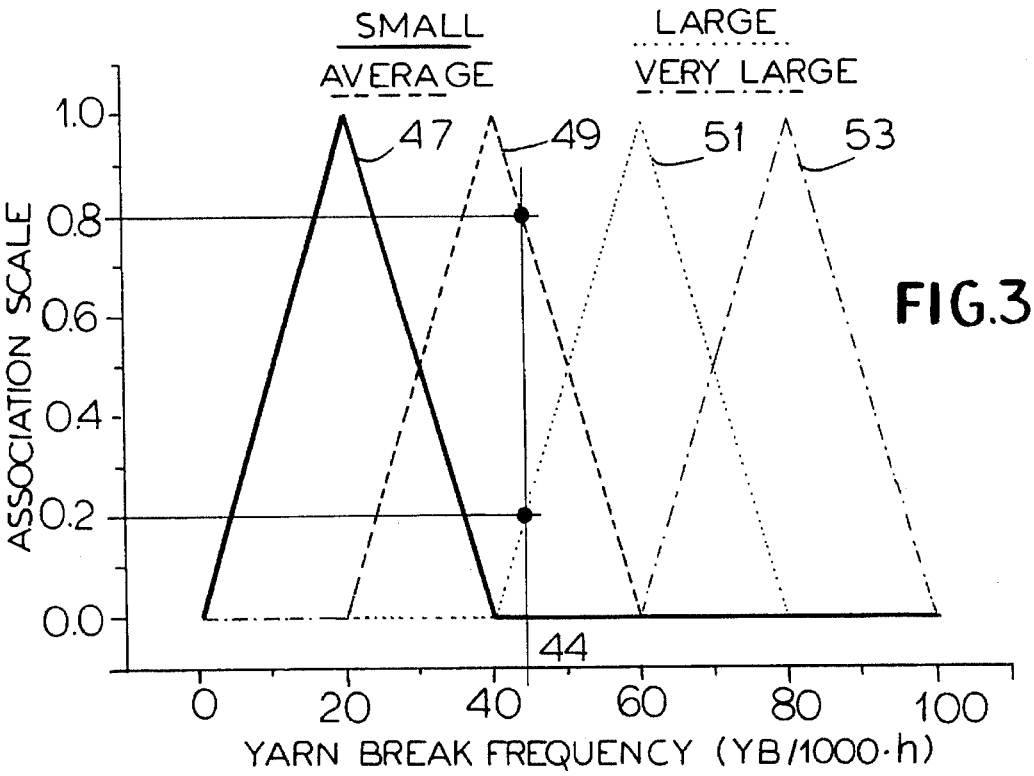
FIG. 3*b* is a graph of the linguistic variable yarn break frequency also resulting from the use of the fuzzy logic controller; add

From FIGS. 3*a* and 3*b* the linguistic variables spinning force and yarn break frequency are shown with the association scale plotted along the ordinate versus the value of the spinning force in centinewtons (cN) and yarn breaks in yarn breaks (yb) per one thousand spindles per hour along the abscissa. The linguistic variables are here given as small, average and large or very large and it can be seen that the numerical values corresponding to these linguistic values are not well defined.

In the case of the linguistic variable spinning force, the small condition is represented at 41, the average condition at 43 and the large condition at 45. In the case of the linguistic variable yarn break frequency in FIG. 3, small is represented at 47, average at 49, large at 51 and vary large at 53. Based upon the association functions shown in FIGS. 3*a* and 3*b*, the fuzzification of the actual values of the spinning force and the yarn break frequency, obtained by measurement via the sensors 25, for example, is carried out. For example, a spinning force of 22*cn* and a yarn break frequency of forty-four breaks per one thousand spindle hours is characterized by the following terms of the linguistic variables spinning force and yarn break frequency.

TABLE 1

| LINGUISTIC VARIABLE SPINNING FORCE | LINGUISTIC VARIABLE YARN BREAK FREQUENCY |
|---|---|
| Small to Degree 0.6 | Small to Degree 0 |
| Average to Degree 0.4 | Average to Degree 0.8 |
| Large to Degree 0 | Large to Degree 0.2 |
| | Very Large to Degree 0 |

In the following Table 2, an example of the if-then rules are given.

TABLE 2

| IF | | | THEN | |
|---|---|---|---|---|
| Spinning Force | Yarn-Break Frequency | Control Weight | Spinning Speed | Yarn-Guide Displacement |
| small | small | 1 | positive | large |
| small | average | 1 | zero | large |
| small | large | 0.7 | negative | large |
| small | very large | 1 | negative | large |
| average | small | 1 | positive | average |
| average | average | 1 | zero | average |
| average | large | 0.7 | negative | average |
| average | very large | 1 | negative | average |
| large | small | 1 | positive | small |
| large | average | 1 | zero | small |
| large | large | 0.7 | negative | small |
| large | very large | 1 | negative | small |

Table 2 thus shows the logical linkage between the linguistic variables of spinning force and yarn break frequency with the fuzzy operator "AND". For this purpose, a "minimum operator" can be defined, i.e. The association of the logical variables $\mu_A$ and $\mu_S$ is defined by the relationship $$\mu_{AAB}=\min\{\mu_A, \mathbf{82}_B\}$$

where $\mu_{AAB}$ is the logical result and A and B refer to the respective linguistic variables.

From the rules of Table 2 it will be apparent that each line of Table 2 defines two rules, one for the yarn guide displacement and one for the spindle speed.

Thus if Table 2 is applied to the aforedescribed example for a spinning force of 22cN and a yarn break frequency of 44 per thousand spindles per hour, the result of the aggregation step is given in Table 3 below:

TABLE 3

| IF | | | Result |
|---|---|---|---|
| Spinning Force | Yarn Break Frequency | Rule Weight | Of The Aggregation |
| small (0.6) | small (0.0) | 1 | 0.0 |
| small (0.6) | average (0.8) | 1 | 0.6 |
| small (0.6) | large (0.2) | 0.7 | 0.14 |
| small (0.6) | very large (0.0) | 1 | 0.0 |
| average (0.4) | small (0.0) | 1 | 0.0 |
| average (0.4) | average (0.8) | 1 | 0.4 |
| average (0.4) | large (0.2) | 0.7 | 0.14. |
| average (0.4) | very large (0.0) | 1 | 0.0 |
| large (0.0) | small (0.0) | 1 | 0.0 |
| large (0.0) | average (0.8) | 1 | 0.0 |
| large (0.0) | large (0.2) | 0.7 | 0.0 |
| large (0.0) | very large (0.0) | 1 | 0.0 |

In each case, the result of the logical combination is multiplied by the weighting factor to yield the aggregation result. The subsequent composition is carried out by treating the output variables of Table 2 based upon the aggregation results from Table 1 as associated values. These results can be seen in Table 4.

TABLE 4

| Spindle Speed | Yarn-Guide Displacement |
|---|---|
| Positive to Degree 0.0 {0.0V0.0V0.0} | Small to Degree 0.0 {0.0V0.0V0.0V0.0} |
| Zero to Degree {0.6V0.4V0.0} | Average to Degree 0.4 {0.0V0.4V0.14V0.0} |
| Negative to Degree 0.14 {0.14V0.0V0.14V0.0V0.0V0.0} | Large to Degree 0.6 {0.0V0.6V0.14V0.0} |

Figure 4A:
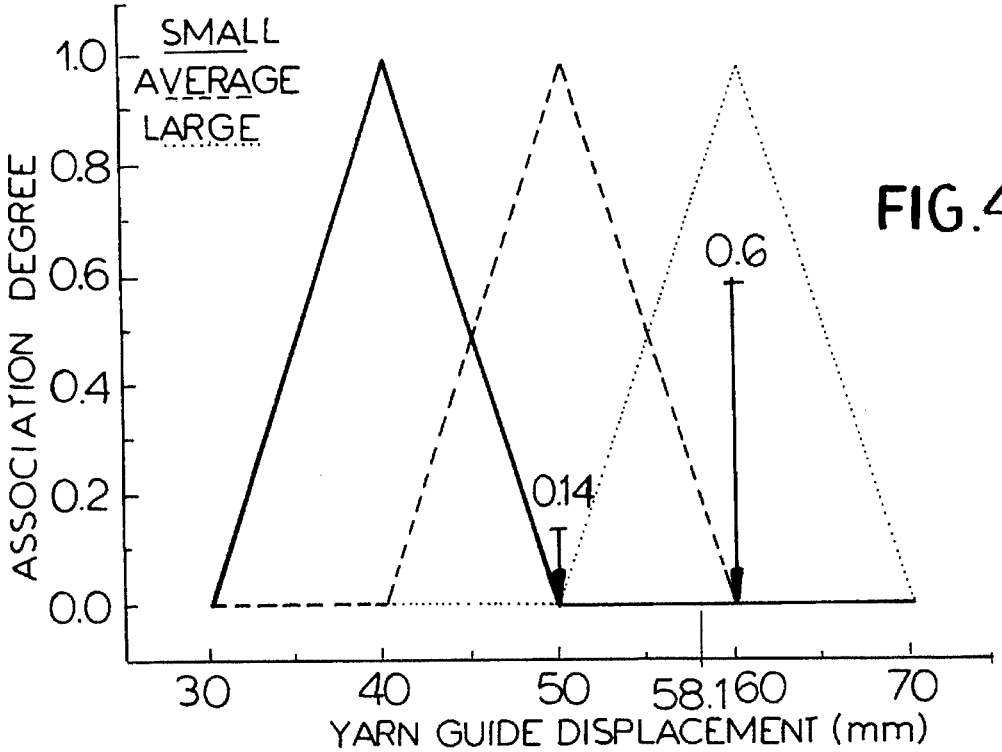
FIG. 4*a* and 4*b* are graphs for the aforementioned terms of the linguistic output variables: FF displacement (yarn-guide displacement) and spindle speed resulting from the input variables of FIGS. 3*a* and 3*b* utilizing the fuzzy controller.
Figure 4B:
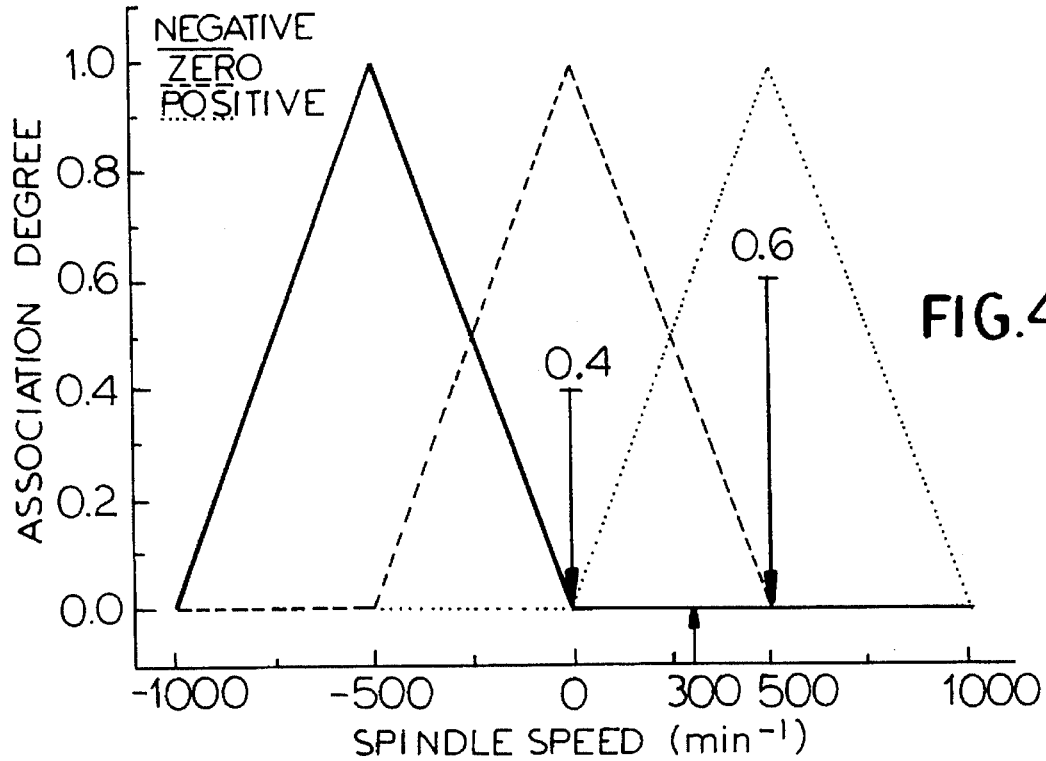

From these results of fuzzy inference, utilizing the association relations of FIGS. 4*a* and 4*b* of the linguistic variables yarn guide displacement and spindle speed with the scales of 0 to 1, the results shown in these figures are obtained. In the simplest way, the defuzzification can be a "center of maximum" process as shown for the linguistic variable spindle speed in FIG. 4*b*. In a second step, a "best compromise" can be determined. For example, a weighting factor can be applied or a shift can be made along the scale between the values given by the Table 4. For instance, in the case of FIG. 4*a*, between the values of 50 and 60 of the displacement, a values of 58.1 is selected and between the values of 0 and 500 in the spindle speed (FIG. 4*b*) 300 RPM is selected, by a weighting favoring a speed increase and the high output that that represents.

The control cycles can repeat at vary short intervals such that rapid changes of the speed geometry can occur for optimum configurations over the entire process. The invention need not use fuzzy control or the described association functions and can use other control variables and techniques serving a similar purpose.

I claim:

1. A process for optimizing the spin geometry of a ring spinning machine in which the spin geometry is defined as a configuration of a path of yarn to be spun extending from a pair of discharge rollers of a drafting frame, past a yarn-guide eye, past a balloon constricting ring, through a traveler orbiting a bobbin tube on a traveler ring and then to the bobbin tube for winding in a bobbin thereon, the bobbin tube is rotatable on a spindle of the ring spinning machine and wherein the ring spinning machine has spin-geometry influencing elements including a movable rail for the balloon constricting ring and means for moving said yarn-guide eye, at least one of said spin-geometry influencing elements having a respective drive for positioning said one of said elements, said process comprising the steps of:

(a) generating at least one measured value selected from a spinning force, a parameter correlated with the spinning force, and yarn-breakage frequency;

(b) feeding said measured value as an input value to a controller; and (c) in said controller generating a control value for said drive for controlling a position of said one of said spin-geometry influencing elements within a predetermined adjustment range so that at least one of (c1) the yarn-breakage frequency, and (c2) the spinning force or a yarn tension does not exceed a predetermined value or is a minimum.

2. The process defined in claim 1, further comprising the step of setting a speed of said spindle with said controller within a predetermined speed range so that at least one of the yarn-breakage frequency, the spinning force and the yarn tension does not exceed a certain threshold or is a minimum.

3. The process defined in claim 2, further comprising the step of generating a failure signal at said controller upon a failure to maintain said adjustment range.

4. The process defined in claim 1 wherein said control value is applied to control a vertical position of said yarn-guide eye.

5. The process defined in claim 1 wherein said control value is applied to control a vertical position of said balloon constricting ring.

6. The process defined in claim 1 wherein said control value is applied to control a vertical position of said spindle and said traveler ring.

7. The process defined in claim 1 wherein said control value is applied to control a horizontal spacing of said spindle from said drafting frame.

8. The process defined in claim 1, further comprising the step of feeding to said controller as at least one additional input at least one value of an environmental parameter.

9. The process defined in claim 1 wherein said environmental parameter is ambient temperature.

10. The process defined in claim 1 wherein said environmental parameter is ambient air humidity.

11. The process defined in claim 10 wherein a plurality of different control values for positioning a plurality of said elements are generated, said process further comprising the step of generating the different control values in succession and sampling and optimizing each of the different control values.

12. The process defined in claim 1 wherein said steps are repeated at time-spaced intervals.

13. The process defined in claim 1 further comprising the steps of:

sampling by said controller samples of said measured values over an interval corresponding to at least part of said adjustment range with respective control values to position said one of said elements, and determining an optimum value of at least one of said control values and outputting the optimum value at said controller.

14. The process defined in claim 1 wherein said controller is operated with fuzzy logic by fuzzifying a measured signal, logically processing and weighting the fuzzified signal to obtain a processed signal, and obtaining a respective control signal with said control value by defuzzifying the processed signal.

15. The process defined in claim 1 wherein a respective one of said measured values is obtained from each of a plurality of spinning stations of the ring spinning machine, said process further comprising the step of averaging said obtained measured values.

16. The process defined in claim 15, further comprising the step of omitting from the averaging of said obtained measured values, measured values obtained from spinning stations of said machine which are smaller than a predetermined threshold.

17. A ring spinning machine, comprising:

at least one spinning station provided with a roving drafting frame formed with a pair of discharge rollers;

a yarn-guide eye of said station traversed by a yarn coming from said pair of discharge rollers;

a balloon constricting ring located at said station and spaced from said yarn-guide eye, said yarn passing from said eye through said balloon constricting ring;

a spindle coaxial with said balloon constricting ring spaced from said balloon constricting ring and receiving a bobbin tube on which a bobbin is wound;

a traveler orbiting said bobbin tube on a traveler ring, said yarn passing from said balloon constricting ring through said traveler and then to the bobbin tube for winding in the bobbin thereon, lengths of yarn segments between said rollers and said eye, between said eye and said balloon constricting ring, between said balloon constricting ring and said traveler, and between said traveler and said bobbin and respective angles between said segments constituting a spinning geometry of the machine;

spin-geometry influencing elements including a movable rail for the balloon constricting ring and means for moving said yarn-guide eye, at least one of said spin-geometry influencing elements having a respective drive for positioning said one of said elements;

means for generating at least one measured value selected from a spinning force, a parameter correlated with the spinning force, and yarn-breakage frequency; and a controller connected said means for generating for receiving said measured value as an input value and generating a control value for at least one positioning drive for at least one of the spin-geometry-influencing elements and controlling a position thereof within a predetermined adjustment range so that at least one of the yarn-breakage frequency, the spinning force and the yarn tension does not exceed a predetermined value or is a minimum.

18. The ring spinning machine defined in claim 17, further comprising means for setting a speed of said spindle with said controller within a predetermined speed range so that at least one of the yarn-breakage frequency, the spinning force and the yarn tension does not exceed a certain threshold or is a minimum.

19. The ring spinning machine defined in claim 17, further comprising means for generating a failure signal at said controller upon a failure to maintain said adjustment range.

20. The ring spinning machine defined in claim 17 wherein said controller is a fuzzy logic controller.

* * * * *